US006477754B1

(12) United States Patent
Alexander

(10) Patent No.: US 6,477,754 B1
(45) Date of Patent: Nov. 12, 2002

(54) DECORATIVE DEVICE ATTACHABLE TO A SHOELACE ON A SHOE

(76) Inventor: Raymond H. Alexander, 1424 Tree Ridge Rd., Richmond, VA (US) 23231

( * ) Notice: Subject to any disclaimer, the term of this patent is extended or adjusted under 35 U.S.C. 154(b) by 0 days.

(21) Appl. No.: 09/922,266

(22) Filed: Aug. 6, 2001

(51) Int. Cl.[7] ..... A43C 7/00; A43B 23/24

(52) U.S. Cl. ..... 24/712

(58) Field of Search ..... 40/636, 665; 24/712, 24/712.1, 712.4–712.7, 713, 715.3; 36/50.1, 136

(56) References Cited

U.S. PATENT DOCUMENTS

| | | | | |
|---|---|---|---|---|
| 2,612,135 | A | | 9/1952 | Iny |
| 3,066,370 | A | | 12/1962 | Epstein |
| 3,122,805 | A | | 3/1964 | Hakim |
| 3,345,707 | A | | 10/1967 | Rita |
| 3,473,198 | A | | 10/1969 | Meier |
| 4,597,198 | A | * | 7/1986 | Schweitzer |
| 5,029,370 | A | * | 7/1991 | Martinez Gimeno |
| 5,099,552 | A | | 3/1992 | Kimbrough |
| 5,195,783 | A | * | 3/1993 | Lavoie |
| 5,649,342 | A | | 7/1997 | D'Andrade et al. |
| 6,240,657 | B1 | * | 6/2001 | Weber et al. |
| 6,247,214 | B1 | * | 6/2001 | Hyde |

FOREIGN PATENT DOCUMENTS

| | | | |
|---|---|---|---|
| WO | WO 88/06011 | * | 8/1988 |

* cited by examiner

*Primary Examiner*—James R. Brittain
(74) *Attorney, Agent, or Firm*—Norman B. Rainer

(57) ABSTRACT

A decorative device adapted to be slideably attached to a shoelace at its lowermost, horizontally transverse portion as it engages the eyelets of a shoe includes a structure foldably adjustable between open and closed states. The structure has a window top portion, a middle portion having display material, and a securing bottom portion. In the close state, the top, middle and bottom portions are in overlying disposition, causing the display material to be visible through the window portion, and forming paired passageways for engaging the shoelace.

11 Claims, 1 Drawing Sheet

DECORATIVE DEVICE ATTACHABLE TO A SHOELACE ON A SHOE

BACKGROUND OF THE INVENTION

1. Field of the Invention

The present invention concerns the decorative modification of footwear, and more particularly relates to the attachment of a visibly distinctive logo to a shoe.

2. Description of the Prior Art

In the case of athletic-type footwear, sometimes referred to as "sneakers", it is well known that visibly distinctive emblems, insignia or trademarks may be attached to the shoe by the manufacturer. It is also known that decorative effects can be added to the sneakers by the user, such effects generally being associated with the laces of the shoe. Exemplary disclosures of such decorative effects are found in the following U.S. Patemts:

U.S. Pat. No. 2,612,135 to Ivy concerns the attachment of small spherical bells to shoelaces.

U.S. Pat. No. 3,066,370 to Epstein discloses a flat button-like device having spaced apart holes for securement by a shoelace, and an upper surface having a decorative clown's head image.

U.S. Pat. No. 3,122,805 to Hakim relates to a button-like device as in the aforesaid Epstein patent securable to shoelaces and having an upper surface having a decorative cat's head appearance.

U.S. Pat. No. 3,345,707 to Rita describes a device for keeping in place the loose ends of a tied shoelace. The overall contour of the device provides a decorative effect.

U.S. Pat. No. 3,473,198 to Meier discloses a hinged device for attachment to shoelaces. An upper component of the device has an ornamental shape, and contains decorative indicia.

U.S. Pat. No. 5,099,552 to Kimbrough concerns a device for decorating the tips of shoelaces.

U.S. Pat. No. 5,649,342 to D'Andrade et. al. relates to a hinged decorative device for attachment to shoelaces.

Although the decorative attachments in the aforesaid patents can be applied by the user to the shoes, none relate to logos. The expression "logo", as employed herein is a symbol, a word or a phrase which denotes an organization such as a sporting team, fraternity, sorority, industrial company, branch of the armed forces, political party, etc., or a social cause. The purpose of displaying the logo is to advertise such organization or establish a contact or camaraderie with other individuals having similar interests or affiliations.

It is accordingly an object of the present invention to apply a decoration such as a logo to a shoe.

It is a more particular object of this invention to provide means whereby a logo can be applied to the shoe by the shoe owner.

It is a further object of the present invention to apply a logo in the aforesaid manner to a sneaker.

It is a still further object of this invention to provide a device for removably applying a logo to the shoelaces of a sneaker. It is another object of this invention to provide a device as in the foregoing object which facilitates the display of varied visually discernible matter.

It is a still further object of this invention to provide a device of the aforesaid nature of durable, simple construction amenable to low cost manufacture.

These objects and other objects and advantages of the invention will be apparent from the following description.

SUMMARY OF THE INVENTION

In one aspect of the present invention, the above and other beneficial objects and advantages are accomplished in accordance with the present invention by a decorative device adjustable between open and closed states for releasibly engaging a shoelace at its horizontal lowermost traversing portion engaging the eyelets of a shoe, said device comprising:

a) a window top portion having a circuitous base of oblong contour centered upon an axis of elongation extending between first and second opposed end regions, b) a display middle portion of substantially flat profile having a perimeter that matches the contour of said base, and joined to said first end region by way of a first living hinge constituting a continuous integral extension of said top portion, said middle portion having a first surface which is downwardly directed in said open state and contains display material, and an opposed second surface upwardly directed in said open state and containing a pair of shoelace-engaging loops centered upon said axis in spaced apart relationship, said display portion being adapted to swing downwardly to produce said closed state wherein:said first surface abuts said base and said loops are now downwardly directed, and c) a securing bottom portion of substantially flat profile having a perimeter that matches the contour of said base and a pair of spaced apart apertures, and joined to said second end region by way of a second living hinge, said securing portion being adapted to swing downwardly into folded abutment with the second surface of said display portion to produce said closed state, enabling said loops to penetrate said apertures to form passageways adapted to grip a shoelace, whereby d) in said closed stat said window, display and securing portions are folded upon each other in overlying relationship, said display material is visible through said window portion, and the device is capable of slidably engaging a shoelace in a manner preventing unfolding of the device.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

As typically employed in the lacing of shoes, a shoelace is caused to pass in sequential zig-zag fashion through an ascending series of laterally opposed pairs of eyelets, emerging from the top pair of eyelets where both end portions of the shoelace are secured together by way of a releasible knot. At the lowermost pair of eyelets, the traversing portion of the shoelace which spans the eyelets is in a horizontal disposition. The several traversing portions of the shoelace above said lowermost pair of eyelets are angularly oriented because of the zig-zag engagement with the paired eyelets.

Figure 1:
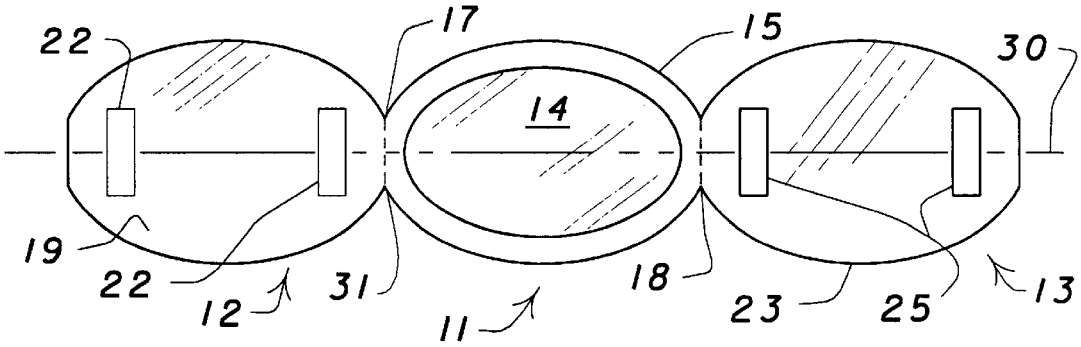
FIG. 1 is a top view of an embodiment of a decorative device of the present invention shown in its open state.
Figure 2:
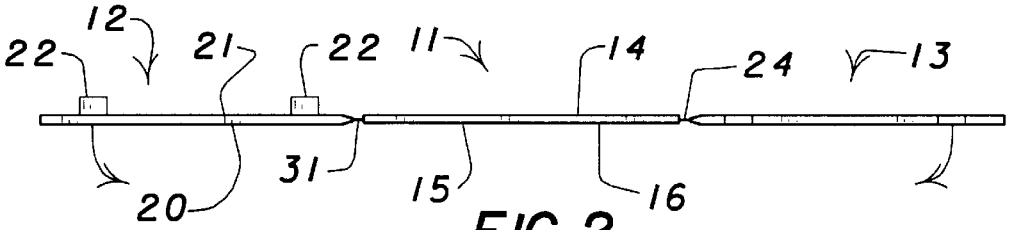
FIG. 2 is a side view of the embodiment of FIG. 1.
Figure 3:
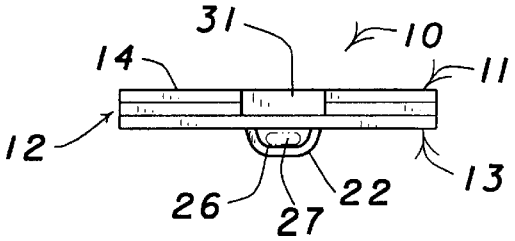
FIG. 3 is an end view taken from the left of FIG. 2 and showing the device in its closed state installed upon a shoelace.
Figure 4:
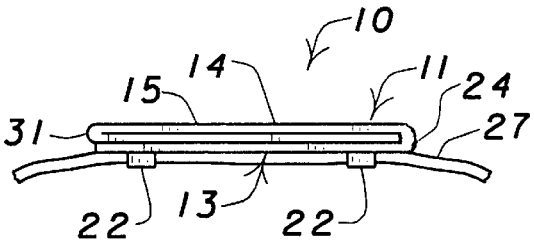
FIG. 4 is a side view of the device of FIG. 1 in its closed state and installed upon a shoelace.
Figure 5:
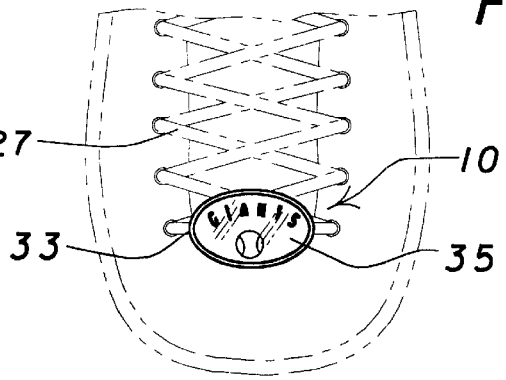
FIG. 5 is a top view of the device as shown in FIG. 4 shown installed upon a shoelace on a shoe.

Referring now to FIGS. 1–5, an embodiment of a decorative device 10 of this invention is shown comprised of a piece of foldable sheet stock such as plastic having integrally joined top, middle and bottom portions, 11, 12 and 13, respectively.

Top, window portion 11 has a transparent interior region 14 bounded by circuitous base 15 of oblong contour constituting the perimeter of region 14 and having a downwardly directed flat surface 16. Base 15 may be further characterized as being symmetrically centered upon an axis of elongation 30, and extending between opposed first and second end regions 17 and 18, respectively. The length of said window portion, measured along said axis, may range from 0.5 to 2.5 inches, and the height of said window portion, measured transversely to said axis, may range from 0.5 to 1.5 inches. The transparent interior region may be continuous with base 15, as when said sheet stock is fabricated of transparent foldable plastic such as plasticized polyvinylchloride. The sheet stock may have a thickness between 0.5 and 2.0 millimeters.

Middle, display portion 12 has a, perimeter 19 that matches base 15, and is joined to said first end region by way of a first living hinge 31 constituting a continuous integral extension of said sheet stock between said top and middle portions. Said middle portion is further bounded by a first surface 20 containing display material and which is downwardly directed in said open state, and second surface 21 which is upwardly directed in said open state. Said second surface 21 contains a pair of loops 22 centered upon axis 30 in spaced apart relationship. Said loops may be fashioned merely by appropriate slitting of portion 12, or may be separate entities adhered to surface 21.

Middle portion 12 is adapted to swing downwardly to produce said closed state wherein said first surface 20 abuts the flat surface 16 of base 15, and wherein said loops are now downwardly directed.

Bottom, securing portion 13 has a substantially flat profile having a perimeter 23 that matches the contour of base 15, and is joined to second end region 18 by way of second living hinge 24. Paired apertures 25 in said bottom portion are centered upon axis 30 and spaced apart the same distance as the spacing between loops 22 of said middle portion. Said bottom portion is adapted to swing downwardly into abutment with second surface 21 of said middle portion in said closed state. Such action enables loops 22 to penetrate apertures 25 to form passageway 26 adapted to grip shoelace 27.

In use, the device is installed upon shoelace 27 and slidably positioned thereupon to approximately mid-length. The shoelace is then threaded through the eyelets of the shoe, causing the device to be located on the horizontal, lowermost transverse portion 33 of the shoelace.

The display material 35 disposed upon first surface 20 may be a logo, and may be printed or contoured matter, a picture or design, and may be luminescent. The device of this invention is preferably produced in a molding or stamping operation as an integral monolithic structure. The living hinges are thinner than adjacent portions of the structure, thereby imparting the necessary flexibility for 180 degrees of pivotal movement. Although the foldable sheet stock employed in fabricating the device is preferably a plastic material, water-resistant cardboard may also be employed. Although interior region 14 of window portion 11 is preferably transparent plastic material, extending as a continuous extension of base 15, said interior region may also be merely empty space, namely an aperture created in the stamping process that produces the device. In still other embodiments, a transparent dome may be mounted atop base 15 so as to form an enclosure for three-dimensional display objects which may be stationary or moveable.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A decorative device adjustable between open and closed states for releasibly engaging a shoelace at its horizontal lowermost traversing portion engaging the eyelets of a shoe, said device comprising:

a) a window top portion having a circuitous base centered upon an axis extending between first and second opposed end regions, b) a display middle portion of substantially flat profile having a perimeter that matches the contour of said base, and joined to said first end region by way of a first living hinge constituting a continuous integral extension of said top portion, said middle portion having a first surface which is downwardly directed in said open state and contains display material, and an opposed second surface upwardly directed in said open state and containing a pair of shoelace-engaging loops centered upon said axis in spaced apart relationship, said display portion being adapted to swing downwardly to produce said closed state wherein said first surface abuts said base and said loops are now downwardly directed, and c) a securing bottom portion of substantially flat profile having a perimeter that matches the contour of said base and a pair of spaced apart apertures, and joined to said second end region by way of a second living hinge, said securing portion being adapted to swing downwardly into folded abutment with the second surface of said display portion to produce said closed state, enabling said loops to penetrate said apertures to form passageways adapted to grip a shoelace, whereby in said closed state said window, display and securing portions are folded upon each other in overlying relationship, said display material is visible through said window portion, and the device is capable of slidably engaging a shoelace in a manner preventing unfolding of the device.

2. The device of claim 1 fabricated as a single monolithic piece.

3. The device of claim 2 wherein said single monolithic piece is foldable sheet stock.

4. The device of claim 3 wherein said sheet stock is a plastic material.

5. The device of claim 4 wherein said plastic material is transparent.

6. The device of claim 5 wherein said display material includes printed indicia.

7. The device of claim 6 wherein said printed indicia is a logo.

8. The device of claim 6 wherein the circuitous base is of oblong contour elongated in the direction of said axis,

9. The device of claim 3 wherein said living hinges are thinner than adjacent portions of said sheet stock.

10. The device of claim 9 wherein said window portion has a length, measured along said axis, of between 0.5 and 2.5 inches, and has a height, measured transversely to said axis, of between 0.5 and 1.5 inches.

11. The device of claim 1 wherein said base is symmetrically contoured with respect to said axis.

* * * * *